United States Patent [19]

Roos

[11] 4,312,201

[45] Jan. 26, 1982

[54] CYLINDER LOCK WITH FORCE-IMMUNE KNOB

[75] Inventor: William G. Roos, Indianapolis, Ind.

[73] Assignee: Best Lock Corporation, Indianapolis, Ind.

[21] Appl. No.: 71,666

[22] Filed: Aug. 31, 1979

[51] Int. Cl.[3] ..... E05B 63/00

[52] U.S. Cl. ..... 70/422; 70/224

[58] Field of Search ..... 70/422, 224, 416, 1.5, 70/107, 1.7, 417

[56] References Cited

U.S. PATENT DOCUMENTS

| | | | |
|---|---|---|---|
| 3,621,685 | 11/1971 | Sargent | 70/422 |
| 3,955,387 | 5/1976 | Best | 70/224 |
| 4,195,502 | 4/1980 | Best | 70/422 |
| 4,201,069 | 5/1980 | Katayama | 70/422 |

*Primary Examiner*—Robert L. Wolfe

*Attorney, Agent, or Firm*—Jenkins, Coffey, Hyland, Badger & Conard

[57] ABSTRACT

A cylindrical lock structure having a key-removable core in its outer knob, modified to provide a function as for hotel room use in which it is operable from the outside by key operation only and the outside knob sleeve or spindle is locked against bolt-retracting rotation relative to the chassis hub, is rendered immune to forcing from the application of excess torque to the outer knob, by mounting the knob neck rotatably on the knob sleeve and hub structure and by providing a rotative slip fit at the periphery of the face plate which closes the core-passing opening at the outer end ot the knob handle and supports such end from the knob sleeve, so as to allow the knob to rotate freely on the non-rotative knob sleeve and hub, and thereby prevent the application of excess torque to the locked knob sleeve.

4 Claims, 5 Drawing Figures

CYLINDER LOCK WITH FORCE-IMMUNE KNOB

This invention relates to a cylindrical lock set such as that shown in U.S. Pat. No. 3,955,387 of May 11, 1976, and having a key-removable core in its outside knob; and more particularly to such a lock set when it is modified, as for hotel room or store room use, to have a "function" which provides that the lock is operable from outside by key operation only and the outer knob is normally inoperable to retract the bolt.

Conventionally, to adapt the lock set for this function, the knob sleeve which carries the outer knob is locked to the fixed outer hub of the lock chassis by a locking lug which lies in aligned notches in the hub and knob sleeve. In the standard construction of the cylinder lock, the outer end of the knob sleeve forms a seat for a key-removable core, the outer end of the knob is supported from the end of the knob sleeve and the core-passing opening at that outer end is closed by structure which is keyed at its outer periphery to the knob and keyed at its inner periphery to the knob sleeve, so that the knob is keyed to that sleeve and the lock is subject to forcing by the application of excess force on the outer surface of the knob, as with a torque wrench.

In the co-pending application of Walter E. Best and R. Gene McCullum, Ser. No. 911,962, filed June 2, 1978 and now U.S. Pat. No. 4,195,502, there is disclosed a modified knob-mounting structure usable in various "functions" of the lock, in which the drive connection between the outside knob and its supporting knob sleeve is by way of a drive ring in the knob neck, having a frangible portion which is adapted to break under the application of excess force to the knob, and thereby to prevent forced retraction of the bolt by such torque application. In that case, while the excess torque breaks the frangible ring and defeats the forcing attempt, it also incapacitates the knob from performing its intended function.

The present invention is particularly applicable to the standard cylindrical lock set when that lock set is made to have a "function" as for hotel room use in which it is operable from the outside by key operation only and the outside knob sleeve or spindle is locked against rotation relative to the chassis hub so as to be inoperable to retract the bolt. The invention is also particularly applicable to a lock set such as that shown in U.S. Pat. No. 3,955,387 in which the neck of the knob contains an inward extending flange having an outwardly disposed side face which is peripherally continuous and in which the knob is retained on the knob sleeve by a keeper which engages that outwardly disposed side face so as to maintain such retaining engagement in any rotative orientation of the knob; and further in which the outer end of the knob is formed with a large central opening to pass a key-removable core mounted in a seat at the end of the knob sleeve and which opening is closed by a circular face plate having its outer periphery in engagement with the knob portion which defines such outer opening and having its inner periphery supported from the knob sleeve.

In accordance with the invention, the outside knob sleeve is locked against rotation in the chassis hub by the conventional locking lug so as to provide the desired key-only outside operation, and the neck of the knob is mounted on the hub and inner portion of the knob sleeve in a relationship which permits such neck to rotate on the hub and knob sleeve while retained thereon by the keeper. At the outer end of the knob, instead of the keyed driving and supporting connection between the knob and sleeve, the outer core-passing opening of the knob receives knob closing and supporting means which has a rotative slip fit at its periphery, preferably its outer periphery, between itself and the surrounding end wall of the knob. Such means desirably includes a face plate which has an inner opening conforming to the non-circular cross section of the key-removable core, with a seat surrounding such opening which receives a face flange on the core, so that the face plate is held against rotation relative to the knob sleeve by interengagement with the noncircular core, and held in place in the knob by the face flange of the core when such core is locked in place in its seat in the end of the knob sleeve.

The accompanying drawings illustrate the invention, and show a preferred embodiment exemplifying the best mode of carrying out the invention as presently perceived. In such drawings.

Figure 1:
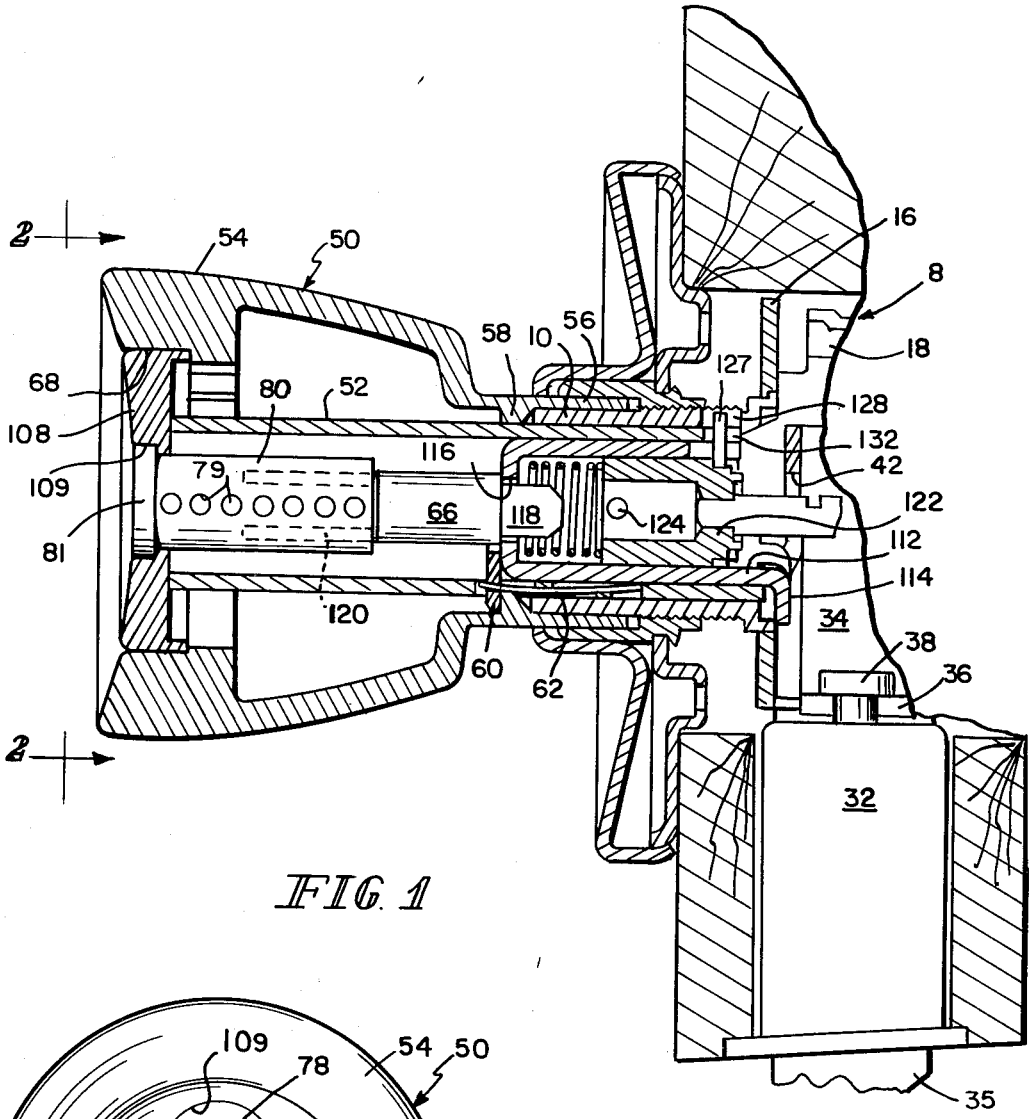
FIG. 1 is a horizontal axial sectional view of the outside knob structure of a cylindrical lock set in accordance with the invention.
Figure 2:
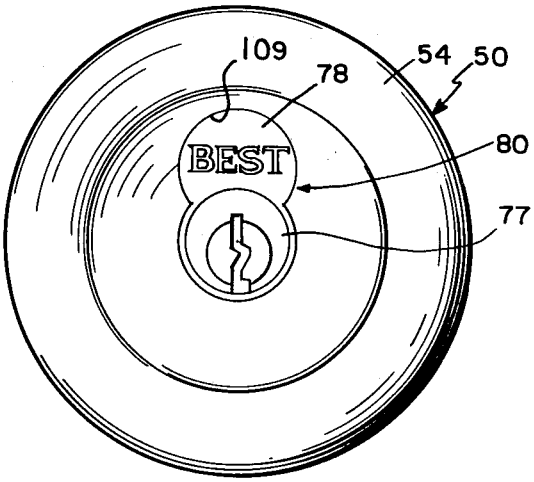
FIG. 2 is an end elevation taken on the line 2—2 of FIG. 1.

The lock set shown in the drawing comprises a chassis 8 including an inner hub 10 fixed to a wide flange 16 at its inner end which forms a side plate that is fixed to the edge of a retractor frame 18 by means of laterally projecting ears 20. The forward end of the frame 18 has its wall edges arranged to interengage with ears at the rear end of a latch bolt housing 32 containing a latch bolt 35, and the frame contains a retractor 34 having jaws 36 for engaging the tail piece 38 of the latch bolt. Such retractor is biased forward by springs (not shown), and at each side carries roll-back cam faces 42.

An outside knob 50 is carried by a knob sleeve 52 rotatably mounted in the outside hub 10. The knob has a hand-hold portion 54 at its outer end, and a neck 56 at its inner end telescopically received over the hub 10 and rotatable thereon. At the outer end of the hub 10, the knob neck 56 has an inner flange 58 with a front bevelled face which bears against the end of the hub 10. The knob is held against retraction from the hub 10 by a keeper 60 projecting through an opening 61 in the side wall of the knob sleeve 52 and engaged against the outer face of the flange 58. The flange is peripherally continuous so that it will be retainingly engaged by the retainer as the knob rotates on the sleeve. The keeper is spring-pressed outward by a spring 62. The outer face of the keeper is bevelled to ride over the bevelled face of the flange 58 as the knob is assembled on the sleeve 52, and the keeper is adapted to be retracted by the insertion of a suitable tool through the open end of the knob when the key-removable core is removed.

Figure 4:
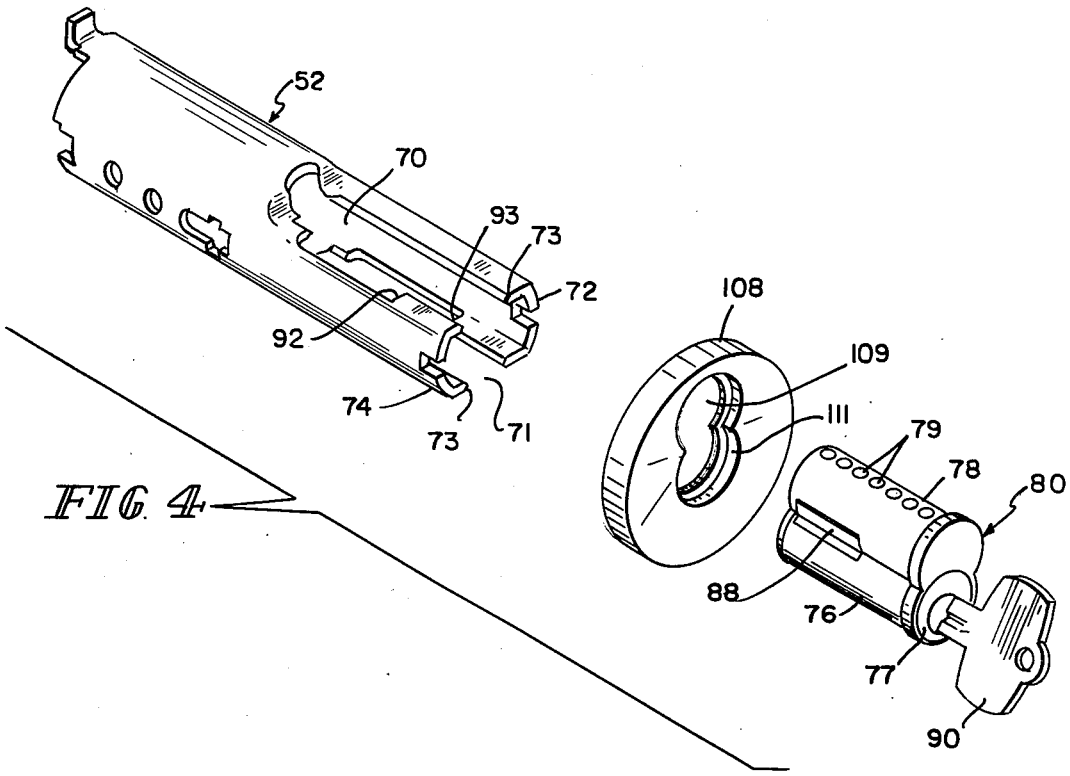
FIG. 4 is a perspective view showing the knob sleeve, face plate, and key-removable core in exploded relation.

The knob sleeve 52 is a standard element of the lock set, adapted to be used in various "functions", but for present purposes may be slightly shortened by machining away a short length of its outer end. The knob sleeve is a generally cylindrical tube which may be formed from flat stock stamped and rolled to shape. As best shown in FIG. 4, its outer end is formed with two diametrically opposite slots 70 and 71, and the remaining wall portions are shaped to form two diametrically opposed channel sections 72 and 74. The side legs of the two channel sections extend inward in two chordal planes, and their inner edges are dressed to fit and embrace the lower lobe 76 of a key-removable core 80, and thus to form a seat for such core. Such core is desirably of figure-8 cross section, having a lower lobe 76 containing a key plug 77 and having an upper lobe 78 containing a row of pin tumblers mounted in bores 79. The inner edges of the channel section 72 and 74 are shaped and positioned to mate with the cylindrical surface of the lower lobe 76 of the core 80, with the upper pair of such inner edges received in the grooves between the upper and lower lobes of the core. The core 80 is retained in position by a lug 88 which normally projects through the side of the core and is retractable by use of a special control key 90. To provide for engagement of the lug 88 in the knob sleeve 52, the upper left and lower right bevelled edges of the pair of channel sections 72 and 74 are notched to form shoulders 92 and 93 behind which the lug 88 of the core can be engaged to prevent retraction of the core from the knob sleeve.

The inner end of the knob sleeve 52 is formed with a roll-back cam 110, shown in FIG. 3, which is part of the standard knob sleeve construction 52 and holds the knob sleeve against axial outward movement but which is not used as a roll-back cam in the "functions" to which the present invention relates, since in them the roll-back sleeve is locked against rotation as described below. A key-actuated roll-back sleeve or carrier 112 is rotatably mounted within the inner end of the knob sleeve 52. This carries a key-actuated roll-back cam 114, shown in end elevation in FIG. 3, which has an outward offset cam face 113 adapted to engage a retractor cam face 42 to actuate the retractor to retract the bolt 35 of the lock.

The key-actuated roll-back carrier 112 has an end wall, shown to the left in FIG. 1, which contains a transverse slot 116 that receives the flat end 118 of a throw member 66. The opposite end of the throw member 66 carries a pair of legs 120 which are received in spaced bores in the rear end of the key plug 77 of the core 80. The cylindrical shank 64 of the throw member 66 is held between the rear end of the core 80 and the front end of the key-actuated roll-back sleeve 112, and is desirably arranged to block retraction of the knob keeper 60.

For purposes of locking the knob sleeve 52 against rotation, and thus to limit lock actuation to that provided by the key-actuated core 80, a locking lug bushing 122 is mounted within the roll-back sleeve 112. In accordance with the present invention which is particularly directed to a cylindrical lock in which the knob sleeve 52 is fixed against rotation in the hub 10, this roll-back sleeve 112 is held against rotation in the sleeve 112 and held axially in a fixed position by a cross pin 124. The end of the bushing 122 carries a locking lug 126 having an inner annular portion rotatably fixed on the end of the bushing 122 and having a radial lug portion 127 which, as shown in FIGS. 1 and 3, is engaged at its outer end in a notch 128 in the hub 10 and extends through a notch 132 aligned therewith in the knob sleeve 52, so as to lock the knob sleeve 52 against rotation in the hub 10.

As mentioned above, and as best shown in FIG. 4, the outer end of the knob sleeve 52 is shaped to form a seat for the reception of a key-removable core 80. As shown, such core has a figure-8 cross section and has an enlarged face flange 81 at its front end. The outer end of the hand-hold 54 of the knob 50 is formed with a large bore 68 coaxial with the knob sleeve 52, and hence coaxial with the key plug 77 of the core 80 mounted in the core seat in the knob sleeve 52. A face plate 108 is mounted in such bore 68. Such face plate is formed with an opening 109 of figure-8 shape mating with the shape of the core 80, with the inner lobe of such opening coaxial with the knob 50 and sleeve 52. The front opening 109 is formed with a peripheral groove 111 to receive the front flange 81 of the core 80, and the face plate is thereby retained by the knob 80 against the front end face of the knob sleeve 52. Since the opening 109 and the core 80 are both of non-circular cross section and are interengaged, the face plate will be supported and held against rotation by the core 80, while the core 80 will be supported and held against rotation with respect to the knob sleeve 52 by the engagement of the core 80 in its seat in the end of that knob sleeve.

In the lock construction shown in U.S. Pat. No. 3,955,387, the outer end of the knob is radially supported from the end of the knob sleeve and is locked in torque-transmitting relation with the knob sleeve by a drive plate (98) which is keyed both to the knob and to the knob sleeve. It is the particular purpose of the present invention to provide for free rotation of the knob with respect to the knob sleeve 52. Accordingly, in accordance with the present invention, the outer periphery of the face plate 108 has a rotative slip fit in bore 68 in which it is received in the end of the knob 50, and the knob 50 is thereby rotatably disconnected from the knob sleeve 52 and is free to rotate thereabout. In the structure shown, the single face plate both closes the bore and supports the knob end from the knob sleeve, but other structure may be used for these purposes. For example, a thinner face plate may be mounted against a spacer ring similar to the drive ring of said patent, but with a slip fit between such ring and the knob.

Operation of the lock mechanism shown is as follows. The chassis 8 and its hub 10 are fixedly mounted in a door in the relation shown, and interconnected with a bolt housing 32 as shown. For purposes of the lock function for which the lock is adapted in accordance with the present invention, the knob sleeve 52 is permanently locked against rotation in the hub 10 by fixing the locking lug bushing 122 and the locking lug 126 in the position shown, in which the radial lug portion 127 lies in the aligned slots 128 and 132 in the hub and knob sleeve 52. The key plug 77 of the core 80 is connected by the throw member 66 to the roll-back carrier 112 which carries the cam 114 in position to engage one of the roll-back cam faces 42 of the retractor 34, so that key actuation of the key plug will rotate the throw member 66 and the roll-back carrier 112 to cause its cam 114 to actuate the retractor 34 to retract the bolt.

Such key actuation will be the only means of retracting the bolt from the outside knob, because the knob sleeve 52 will be permanently locked against rotation in the chassis and hub 10 and hence will not be rotatable, as it is in other functions, to actuate the retractor. The neck 56 of the knob 50 is mounted for rotation on the hub 10 and knob sleeve 52. The outer end of the knob 50 will receive radial support from the face plate 108 which is held by the core 80 against the end face of the knob sleeve 52. Since the core 80 will be mounted in the supporting seat in the end of the knob sleeve 52 and will itself support the face plate at its inner periphery, such face plate will be in supported engagement with such knob sleeve 52. The interface between the outer periphery of the face plate 108 and the surrounding end wall of the hand-hold 54 will provide a rotative slip fit between the knob and the non-rotatable end face 108. Accordingly, the knob will be free to rotate about the fixed knob sleeve 52 and face plate 108, and while it will be supported by such fixed parts, it will not transmit substantial torque tending to rotate those parts. Accordingly, it will not be possible to apply torque to the knob 50 and thereby to twist the knob sleeve 52 in the hub 10 to override the locking lug 127 which holds the knob sleeve 52 against rotation to retract the bolt.

Figure 5:
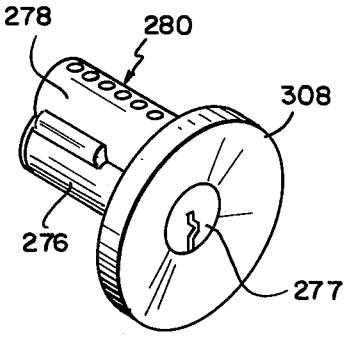
FIG. 5 is an isometric view of an alternative round face core unit which combines the core and face plate.

In the round-face core unit shown in FIG. 5, the core and face plate are combined in a single unit. This comprises a core portion 280 having a body cylinder 276 and a pin tumbler section 278. The body cylinder contains a key plug 277. The core portion 280 is rigidly fixed to the round face portion 308, and the latter has a single central opening on the axis of the body cylinder 276, through which the key plug 277 is exposed. This round-faced core unit can be substituted directly for the separate core 80 and face plate 108 shown in the previous figures. The round-face plate portion 308 of the unit may be of the same size and configuration as the separate face plate 108, or can be of a standard other configuration, and mounted against a spacer plate, as in the co-pending application Ser. No. 911,962, which is rotatable in the knob. In either case, there will be a slip joint between the knob sleeve and the end wall of the hand-hold 54, so that the knob will be free to turn about the axis of the knob sleeve 52 in the same manner as previously described.

Figure 3:
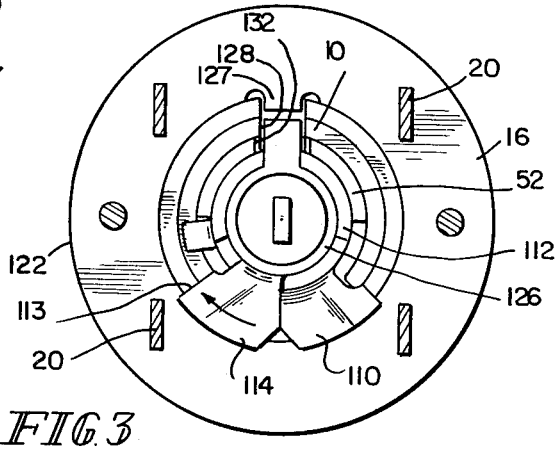
FIG. 3 is a sectional view taken on the line 3—3 of FIG. 1.

In the lock mechanism shown, key actuation of the core 80 to cause the roll-back cam 114 to move against the cam portion 42 of the retractor 34 and retract the bolt 35 requires rotation of the key plug 77 to the left or counterclockwise as viewed from the front of the outside knob—opposite from the clockwise movement indicated in FIG. 3. To provide right-hand or clockwise rotation fo the key plug 77, it is obvious and within the skill of the art to reverse the hand of the pertinent parts to provide such right-hand operation.

I claim:

1. A cylinder lock having an outer knob structure adapted to function by key operation only and having a knob which functions as a handle only and not to retract the lock bolt, said lock having a chassis including an outer hub, a knob sleeve mounted coaxially in said hub, and a locking lug locking the sleeve against rotation relative to the hub, the outer end of the sleeve forming a core seat for the reception of a key-removable core having a central lobe containing a rotary key plug and having a laterally projecting pin tumbler housing, a roll-back cam carrier rotatably mounted in the knob sleeve, having a roll-back cam at its inner end for actuating a bolt retractor, and means for connecting the cam carrier for operation by the key plug of a core mounted in said core seat, wherein the improvement comprises a knob having a neck portion mounted for rotation on said hub and knob sleeve structure and having a hand-hold at its outer end formed with a large circular opening coaxial with the knob sleeve and adapted to pass the key-removable core to and from said core seat, and means for closing said circular knob opening and supporting the outer end of the knob from the knob sleeve, said means including a face plate in said knob opening and having an inner opening surrounding a portion of the core so as to expose the key plug thereof for key insertion, said closing and supporting means having a rotary slip fit at a peripheral face thereof which allows the knob to rotate freely under low turning force and thereby to render said lock immune to forcing by the application of high torque to said knob.

2. A cylinder lock as in claim 1 in which said closing and supporting means comprises a face plate having non-rotatable engagement with a key-removable core non-rotatably received in said core seat so as to be secured against rotation relative to said knob sleeve and has at its outer periphery a rotary slip fit in the knob hand-hold.

3. A cylinder lock having an outer knob adapted to function as a handle only and not to retract the bolt of the lock, said lock having a chassis hub and a knob sleeve coaxially mounted therein and secured against rotation relative to the hub, the knob sleeve forming a core seat at its outer end for the reception of a key-removable core having a key plug, and means for connecting said key plug for actuating a bolt retractor, wherein the improvement comprises a knob mounted at its inner end for rotation about said knob sleeve and having a circular opening at its outer end to pass a core to and from said core seat, and a face plate interengaged with said core and mounted in said circular knob opening, said face plate having a rotary slip fit in the outer end of the knob so as to allow the knob to rotate freely on the knob sleeve under low torque and thereby prevent the forced rotation of the knob sleeve by the application of high torque to the knob.

4. A cylinder lock as in any of claims 1–3 in which the knob has an inner flange intermediate the length of the knob sleeve, and in which the knob is retained on the knob sleeve by a retainer mounted in the sleeve and engaged with an end face of such flange, such end face being circumferentially continuous so as to permit knob rotation and to maintain knob retention as the knob is rotated.

* * * * *